US006332246B1

(12) United States Patent
Camozzi

(10) Patent No.: US 6,332,246 B1
(45) Date of Patent: Dec. 25, 2001

(54) LOCATING FRAME FOR UNITS FOR DRAWING AND COMPACTING BUNDLES OF TEXTILE FIBERS

(75) Inventor: Attilio Camozzi, Brescia (IT)

(73) Assignee: Marzoli S.p.A., Brescia (IT)

( * ) Notice: Subject to any disclaimer, the term of this patent is extended or adjusted under 35 U.S.C. 154(b) by 0 days.

(21) Appl. No.: 09/875,145

(22) Filed: Jun. 7, 2001

(30) Foreign Application Priority Data

Jun. 8, 2000 (IT) ..... T020A0548

(51) Int. Cl.[7] ..... D01H 5/82

(52) U.S. Cl. ..... 19/258; 57/315; 19/261; 19/244

(58) Field of Search ..... 57/315; 19/237, 19/258, 259, 261, 265, 266–268, 269, 270, 271, 272, 244, 251, 254, 255, 267, 278

(56) References Cited

U.S. PATENT DOCUMENTS 2,696,643 * 12/1954 Dolling et al. ..... 19/258
4,391,021 * 7/1983 Kamel ..... 19/258
4,551,887 * 11/1985 Uematsu ..... 19/258
4,768,262 * 9/1988 Gunter ..... 19/258
5,303,454 * 4/1994 Stahlecker et al. ..... 19/258
5,915,510 * 6/1999 Dinkelmann et al. ..... 19/258

* cited by examiner

*Primary Examiner*—Danny Worrell
(74) *Attorney, Agent, or Firm*—Sughrue Mion, PLLC

(57) ABSTRACT

A locating frame for drawing and compacting units of a pair of adjacent spinning stations in a spinning machine where each drawing unit has a pressure roller which supplies the bundle of fibers to the compacting unit and which rotates a pressure roller of the compacting unit, by means of a belt transmission. The frame comprises: two pairs of seats for housing and keeping parallel and spaced apart two axles on which the pressure rollers of the drawing units and the pressure rollers of the compacting units of the two adjacent stations are mounted rotatably, longitudinal arms acting on the axles in order to keep the pressure rollers of the same spinning station aligned longitudinally, and transverse arms for keeping the transmission belts of the two adjacent stations, respectively, aligned with ring gears fixed for rotation with the pressure rollers.

13 Claims, 6 Drawing Sheets

LOCATING FRAME FOR UNITS FOR DRAWING AND COMPACTING BUNDLES OF TEXTILE FIBERS

BACKGROUND OF THE INVENTION

The present invention relates to a locating frame for units for drawing and compacting bundles of textile fibres.

The field of application of the present invention is that of spinning machines provided with a plurality of adjacent spinning stations, in each of which there is a drawing unit associated with a compacting unit, for transforming a roving or bundle of textile fibres into a twisted yarn.

FIG. 1 is a partially-sectioned side view of a drawing and compacting unit of a spinning station in a spinning machine including a plurality of stations (not shown) disposed side by side in a direction defined herein as a transverse direction.

With reference to FIG. 1, a bundle of fibres or roving 1 is supplied to a drawing unit, generally indicated 2, which usually comprises three pairs of members that draw the roving along at increasing linear velocities in order to attenuate it gradually.

In the drawing unit 2, a first pair of rollers 3, 4 takes up the roving at a controlled linear velocity. The roller 4 is rotated in accordance with the arrow A and the upper counter-roller 3 is freely rotatable on an upper support 5 in order to be pressed against the roller 4 with the crude roving interposed between them A second pair of members of the drawing unit comprises belts 6, 7, of which the lower belt 6 is circulated by a motor-driven roller 8 at a linear velocity greater than the output velocity of the first pair of rollers 3, 4, and the upper belt 7 is circulated about an idle roller 9 and a bar 10, both mounted on the upper support 5. A third pair of drawing members comprises an idle upper roller 12, pressed against a lower roller 11 which is driven with a linear velocity greater than that of the second pair of drawing members.

The roving output by the drawing unit 2 then goes to a compacting unit 13 disposed downstream of the drawing unit, before being sent for twisting.

The compacting unit 13 comprises a lower, fixed tube 14 connected to a suction source; the tube 14, which is common to several spinning stations disposed side by side, has a narrow suction slot 15 arranged on the path of the roving and along its direction of advance, in each station. A filter element 16 which preferably consists of a movable loop of flexible textile material that covers the corresponding slot 15 with a wide margin, is circulated about the fixed tube 14 by an upper pressure roller 19 of elastomeric material which presses the roving against the filter loop 16.

The path of each filter loop 16 is defined by the upper surface of the tube 14 and by a guide bar 17 provided with a resilient element 18 for keeping the filter loop 16 taut.

As a result of the suction, the fibres of which the roving 1 is composed are drawn towards the slot 15 and are squeezed together and compacted transversely on the filter surface 16.

The thread output from the compacting unit 13 is distributed and wound, in known manner, on a spindle (disposed downstream and not shown), rotated at high speed. The rotation of the spindle, drawing in the thread supplied by the drawing unit, drives a traveller which runs on a circular track of the spinning ring and produces a twist in the fibres, about the axis of the thread; the pressure exerted by the roller 19 prevents the twist which rises from the spindle from being propagated upstream of the point at which the thread is released by the roller 19.

The pressure roller 19 is rotated by the last pressure roller 12 of the drawing unit, by means of a belt transmission 20. The peripheral velocity of the pressure roller 19 is slightly greater than that of the rollers 11, 12 to ensure that the roving is not too slack in the section in which it passes over the suction slot.

SUMMARY OF THE INVENTION

The object of the present invention is to ensure the correct location of the axles on which the pressure rollers of the last pair of members of the drawing unit and of the compacting unit are rotatable. In particular, it is desired to keep the axles of the above-mentioned pressure rollers correctly spaced and parallel.

Another object of the invention is to keep the belts which transmit the rotation from the last pressure roller of the drawing unit to the pressure roller of the compacting unit correctly aligned.

These objects are achieved, according to the present invention, by a device having the characteristics defined in claim 1.

Further important characteristics of the invention are defined in the dependent claims.

BRIEF DESCRIPTION OF THE DRAWINGS

The characteristics and the advantages of the invention will become clear from the detailed description of an embodiment thereof, given with reference to the appended drawings provided by way of non-limiting example, in which.

DETAILED DESCRIPTION OF THE INVENTION

Figure 1:
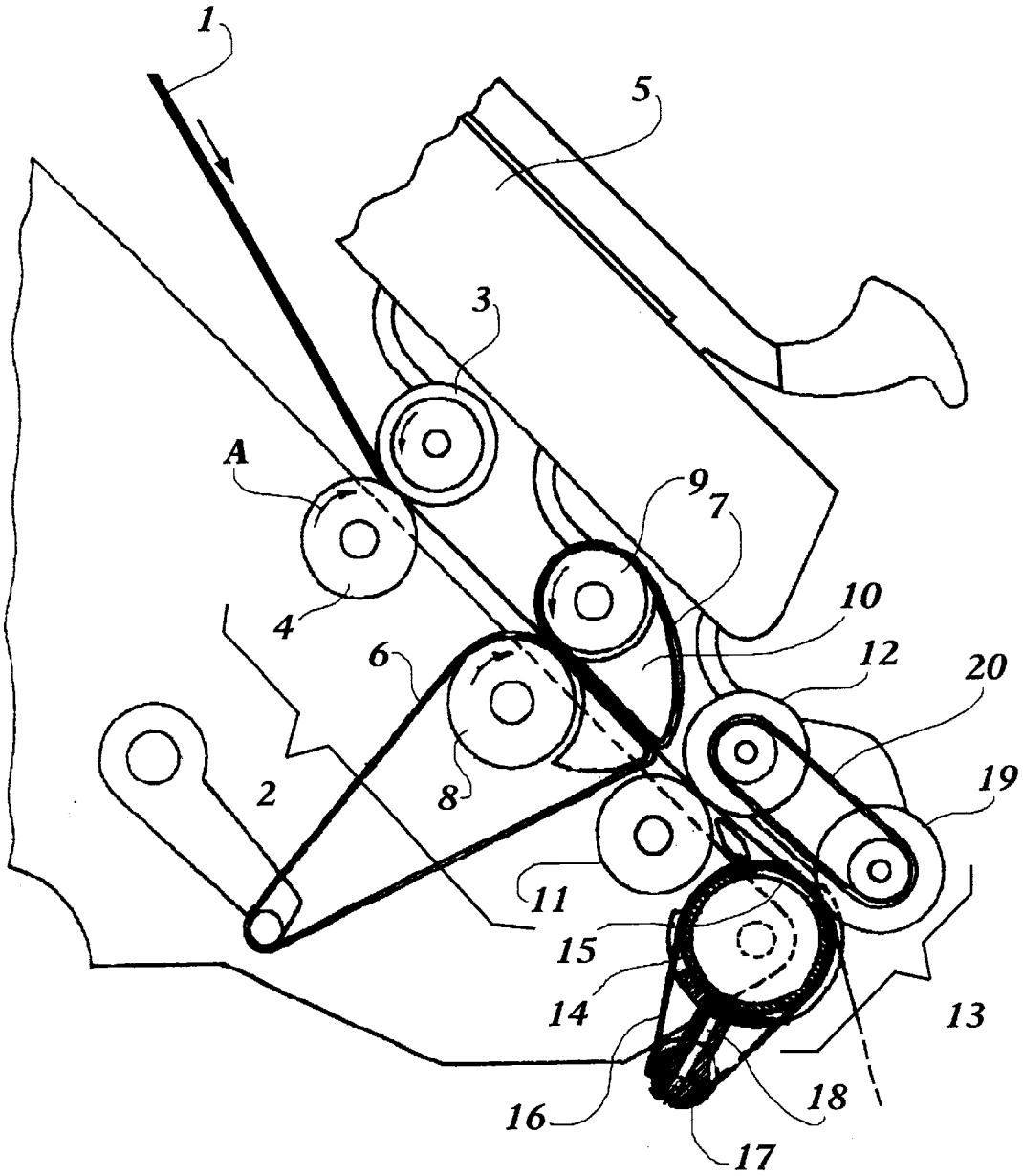
FIG. 1 is a partially-sectioned side elevational view of drawing and compacting units of a known spinning station.
Figure 2:
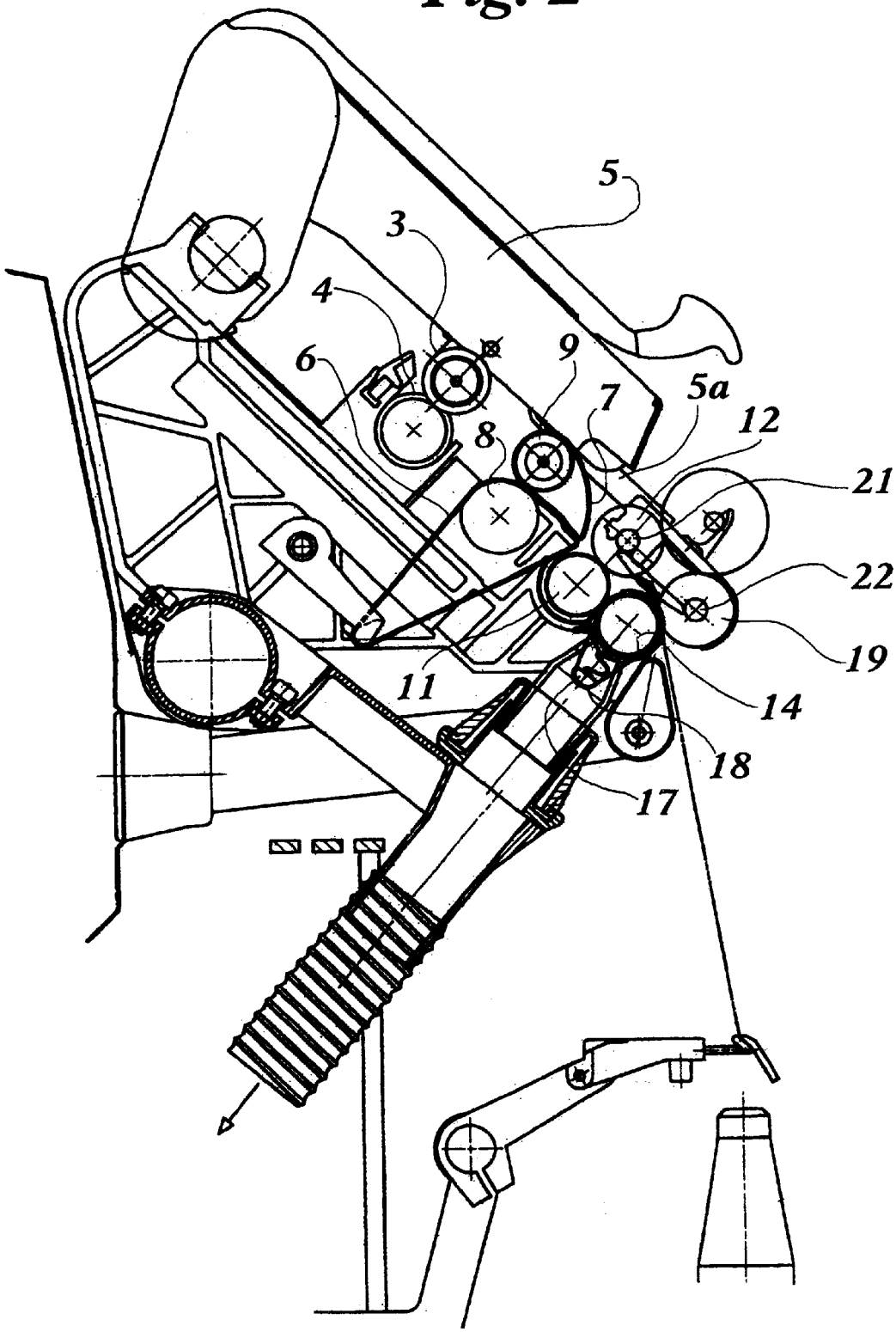
FIG. 2 is a partially-sectioned side elevational view of drawing and compacting units of a spinning station provided with a locating frame according to the invention.

The general layout of the drawing and compacting units shown in FIG. 2 can be considered generally known. Only elements of specific importance and interest for the purposes of the implementation of the present invention will therefore be described in detail below. For the construction of the parts and of the elements not described in detail, reference may therefore be made to a solution of the type described in the introductory portion of the description, or to any known spinning station.

Figure 5:
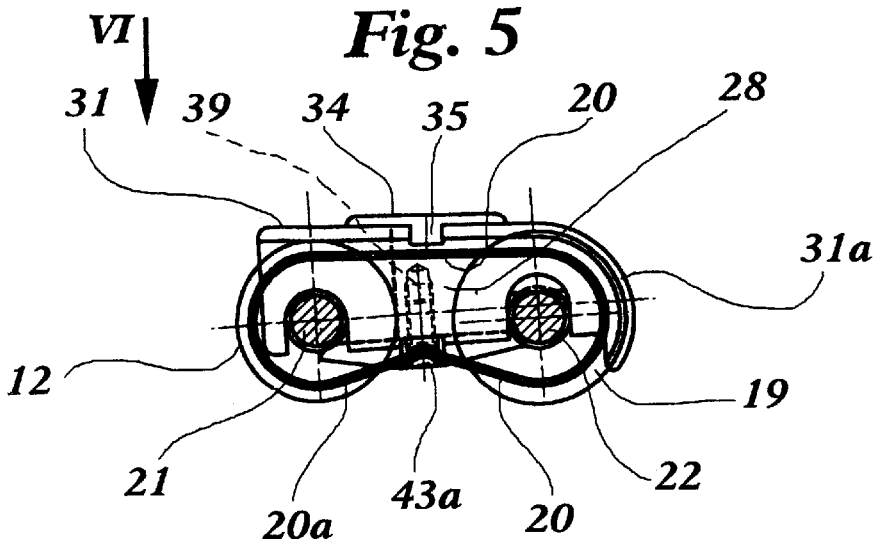
FIG. 5 is a side elevational view of the frame, assembled with a protective cover.
Figure 6:
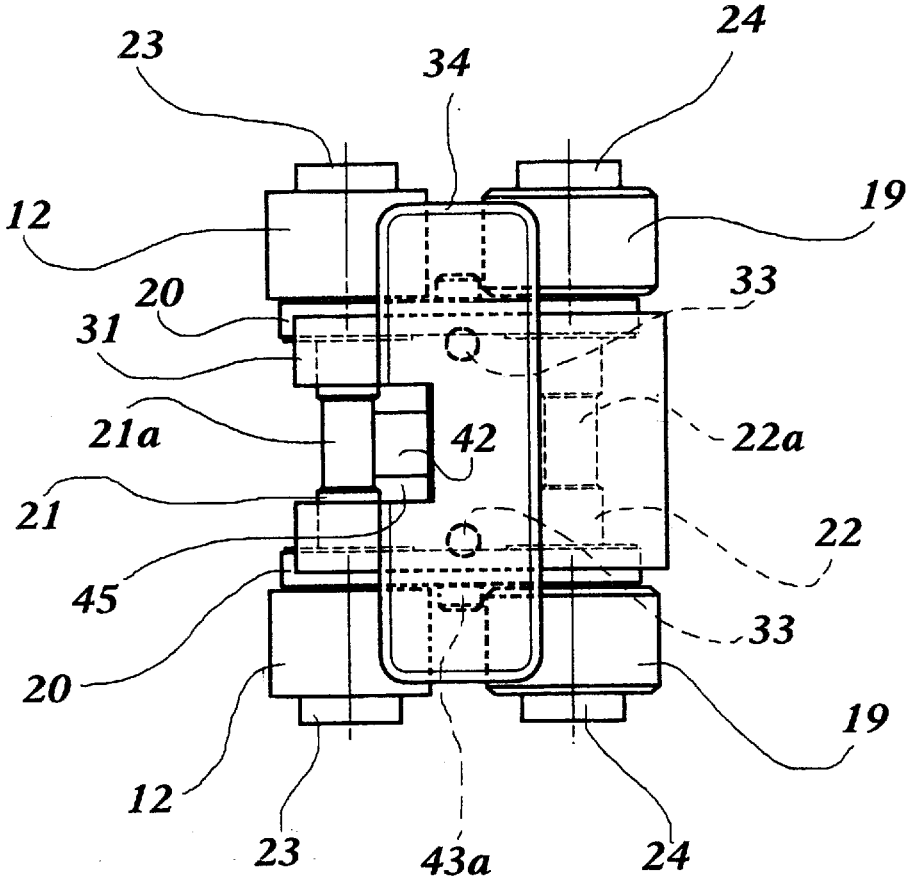
FIG. 6 is a view from above, taken on the arrow VI of FIG. 5.

With reference to FIGS. 2, 5 and 6, in two adjacent spinning stations, the pressure rollers 12 and 19 are mounted rotatably by means of rolling-contact bearings (not shown for simplicity) on one end of respective axles 21, 22 which carry, at their opposite ends, identical pressure rollers 12, 19 of an adjacent spinning station. In greater detail, the rollers 12, 19 are fitted tightly on cylindrical elements 23, 24 fixed for rotation with the outer rolling rings of the above-mentioned bearings.

Each of the last pressure rollers 12 of the drawing unit of a spinning station rotates the next pressure roller 19 of the compacting unit by means of a toothed belt 20 wound around ring gears 25, 26 fixed to or integral with the cylindrical elements 23, 24.

Figure 3:
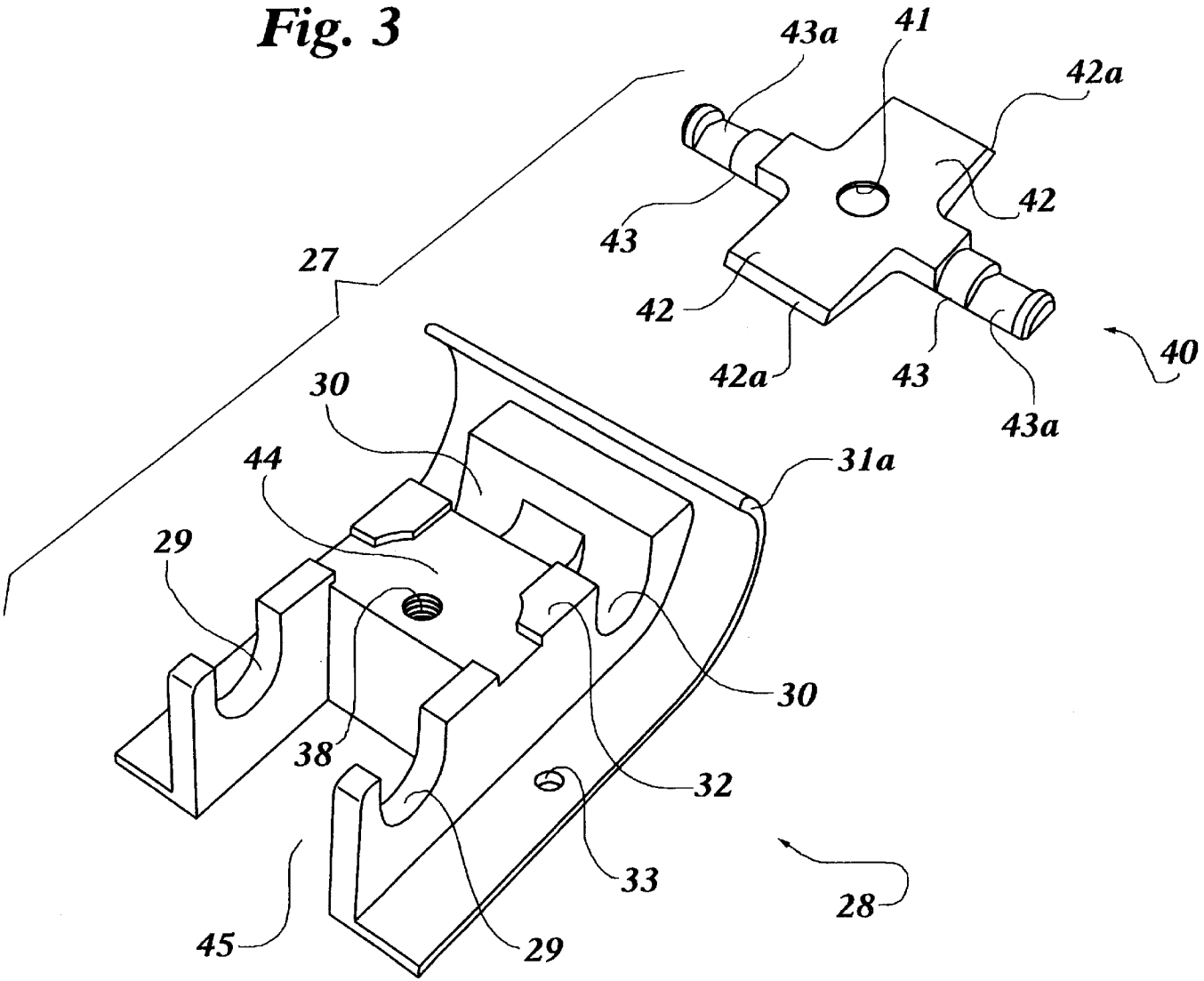
FIG. 3 is an exploded perspective view showing the locating frame according to the invention, from below.

The axles 21, 22 are mounted in a locating frame, generally indicated 27 (FIG. 3).

In the preferred embodiment, the frame 27 comprises a body 28 of moulded plastics material which has a symmetrical structure with respect to a vertical and longitudinal median plane. The body 28, which is shown separately in FIG. 3, is shaped in various ways so as to form two pairs of opposed lateral seats 29, 30 for housing the axles 21, 22, an upper surface 31 arranged for the mounting of a protective cover or of a cleaning roller (as will be explained further below), and a lower surface 32 arranged for the mounting of a multifunctional locating element 40.

The lateral seats 29, 30 are in the form of inverted U-shaped recesses aligned in pairs parallel to a horizontal transverse axis (perpendicular to the direction of advance of the thread). In the preferred embodiment, the seats 29, 30 are shaped so as to have a width corresponding to that of the axles 21, 22 so as to house them with slight clearance or with minimal interference.

In the upper surface 31 of the body 28 there is a pair of holes 33 (FIGS. 5 and 6) for housing corresponding pins 35 projecting from the bottom of a substantially rectangular cover 34. The cover 34 is of a size such as to cover the region between the two rollers 12 and 19 above the respective slots 14 in both adjacent spinning stations, to reduce the amount of dust drawn into the slot when the spinning machine is in operation.

Figure 7:
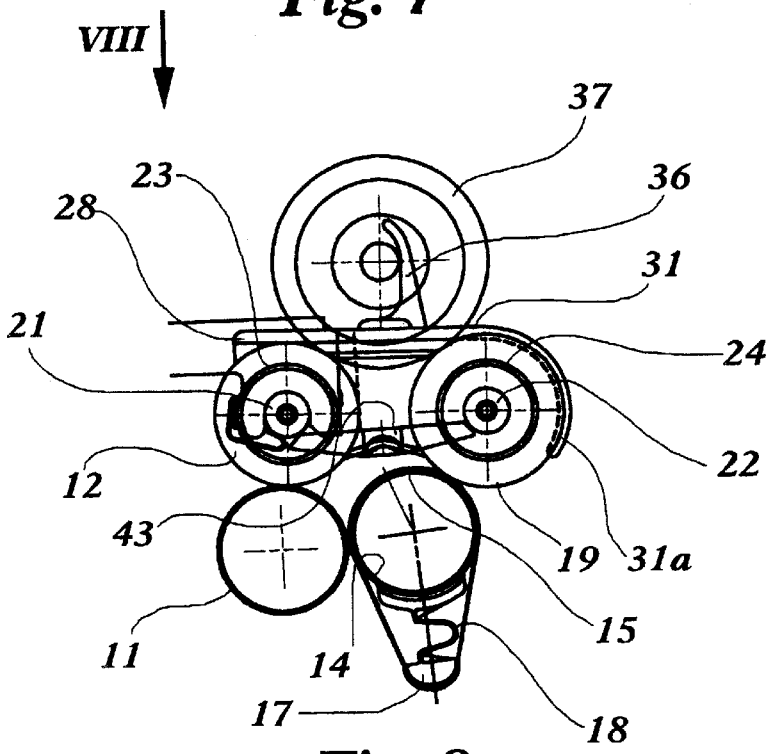
FIG. 7 is a side elevational view of the frame, assembled with a cleaning roller.
Figure 8:
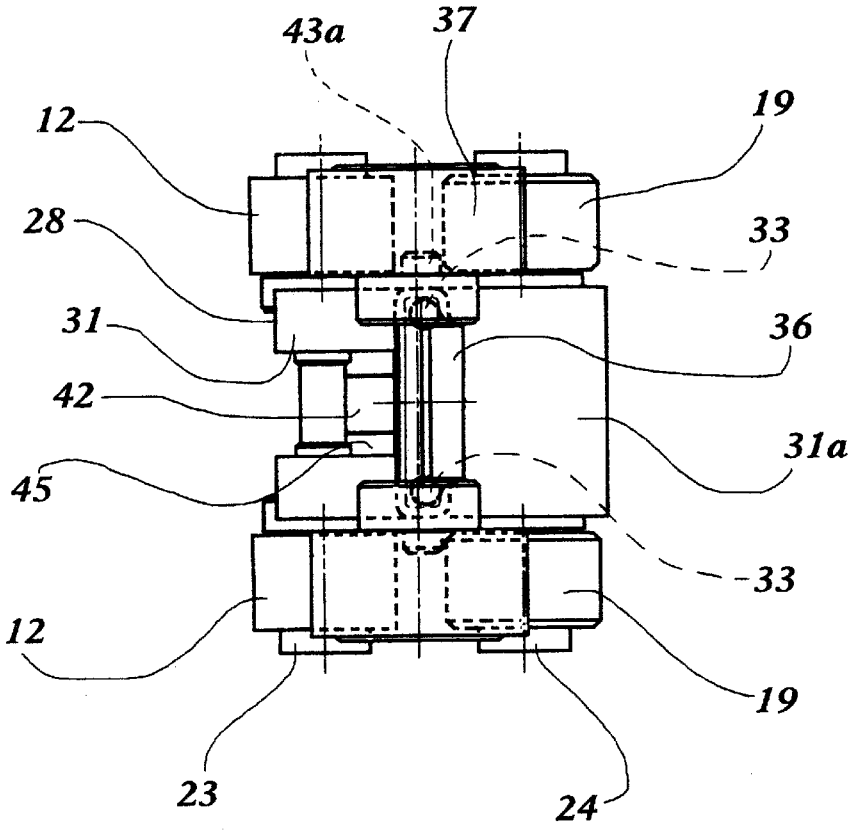
FIG. 8 is a view from above, taken on the arrow VIII of FIG. 7.

Alternatively, as shown in FIGS. 7 and 8, the holes 33 may serve for the releasable mounting, on the locating frame 27, of a bracket-like device 36 which extends vertically from the upper surface 31 of the body 28 in order to hold a cleaning roller 37 engaged on top of and straddling the two pressure rollers 12 and 19 of the same spinning station. The cleaning roller 37, which is made of spongy material or the like, is freely rotatable and is forced to roll on the upper portions of the pressure rollers 12, 19, keeping them clean.

The upper surface 31 of the plastics body 28 is extended at the front to form an arcuate appendage 31*a* for covering and protecting the pressure rollers 19 of the compacting units of the two adjacent spinning stations and for preventing the formation of windings of fibres on the rubber rollers 19.

In the embodiment shown, the pins 35 and the holes 33 constitute quick snap-engagement elements, but it is intended that they may be replaced by different releasable connection means, for example, of the threaded type.

A threaded hole 38 is formed centrally in the lower surface 32 of the body 28, which is that facing the bundle of fibres, for the fixing of a cross-shaped, rigid, multifunctional element, generally indicated 40, to the frame 27, by means of a conical-headed fixing screw 39; the cross-shaped element 40 has an upwardly-tapered frustoconical seat 41 in a baricentric position, for housing the head of the screw 39.

As can best be seen in FIG. 3, the cross-shaped element 40 has a first, longitudinal pair of opposed and aligned arms 42 the ends 42*a* of which are shaped for engaging smaller-diameter central portions 21*a*, 22*a* of the axles 21, 22 (FIG. 4) so as to keep these axles in correct transverse positions with the rollers 12, 19 of both of the spinning stations arranged centrally on the path of the thread being compacted. The ends 42*a* of the longitudinal arms 42 are preferably chamfered at the bottom in directions substantially tangential to the surfaces of the central portions 21*a*, 22*a* of the axles 21 and 22.

Figure 4:
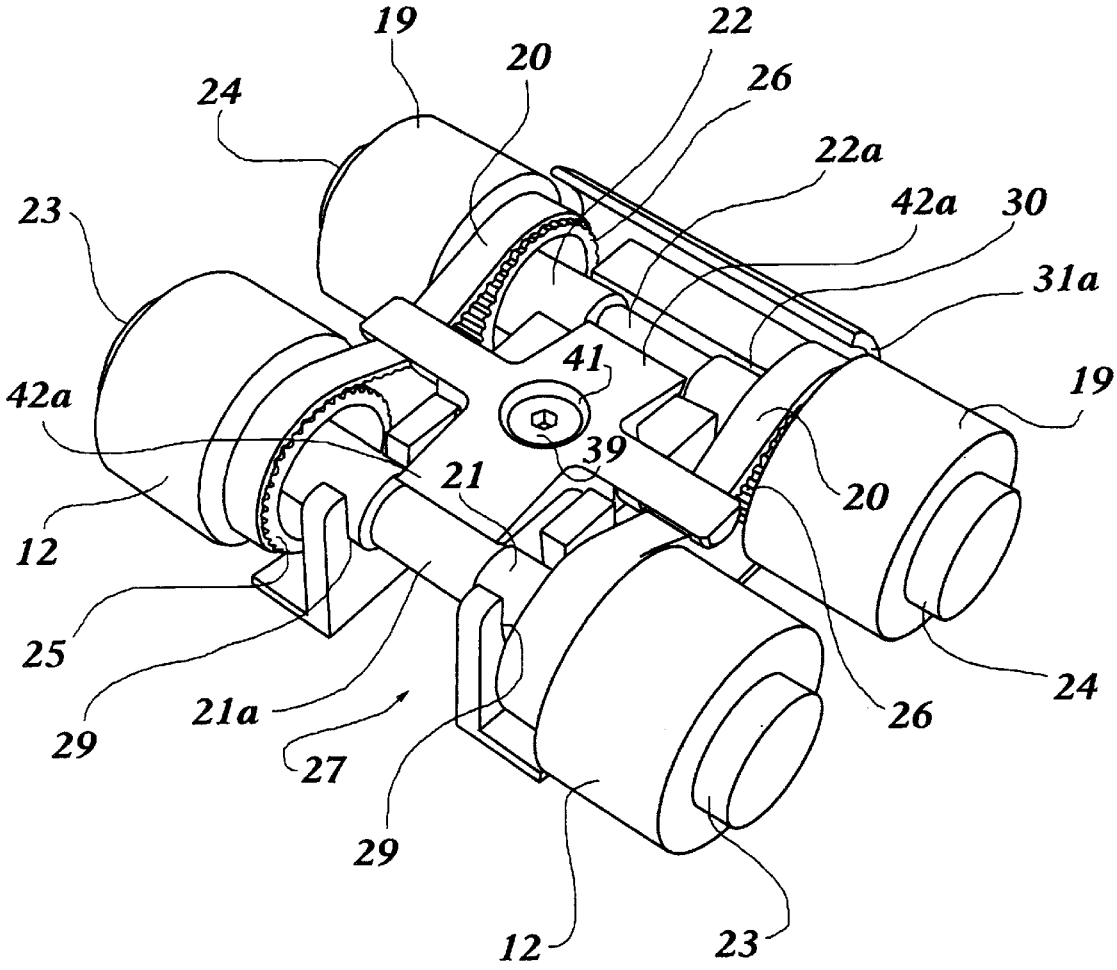
FIG. 4 is a perspective view showing the frame of the invention from below, in the assembled condition.

As can be seen in FIG. 4, the longitudinal arms 42 extend in a longitudinal direction in a manner such that their ends prevent the axles 21 and 22 from accidentally slipping out of the seats 29 and 30 during assembly or maintenance when the frame 27 is removed from the spinning machine.

The cross-shaped element 40 has a second, transverse pair of arms 43 which extend transversely beyond the toothed belts 20 so that the lower lengths 20*a* of the belts extend in respective arm portions 43*a* of reduced thickness which form lateral shoulder surfaces for keeping each belt correctly aligned in engagement with the ring gears 25 and 26. The portions 43*a* of reduced thickness preferably have smooth and rounded surfaces to reduce the friction produced by the belts.

As shown in FIG. 3, a recessed region 44 is formed in the lower surface 32 of the body 28 for engaging the longitudinal arms 42 and/or the transverse arms 43 so as to keep the cross-shaped element 40 oriented in the longitudinal and transverse directions. To ensure and to regulate the tension of the transmission belts 20, the recessed region 44 may have a depth such that the cross-shaped element 40 can be locked selectively at different levels according to the extent to which the screw 39 is screwed into the hole 38. Tightening of the screw 39 thus determines the degree of tension in the belts 20 (FIG. 5).

In order to mount the frame 27 on the spinning machine, a rear and central portion of the plastics body 28 (see FIGS. 3, 6 and 8) has a recess 45 in which the front end of an arm-like portion 5*a*, which projects forwards from the upper support 5 (FIG. 2), is fitted; the arm-like portion 5*a* forms a seat (not shown) which houses the axle 21 of the pressure rollers 12 of the drawing unit.

What is claimed is:

1. A locating frame for drawing and compacting units of a pair of adjacent spinning stations in a spinning machine, in which a drawing unit associated with a compacting unit is provided in each station for drawing and compacting a bundle of textile fibres, and in which each drawing unit has a pressure roller from which the bundle of fibres is passed to the compacting unit and which rotates a pressure roller of the compacting unit, by means of a transmission belt, the frame comprising:

two pairs of seats for housing and keeping parallel and spaced apart two axles on which the pressure rollers of the drawing units and the pressure rollers of the compacting units of the two adjacent stations are mounted rotatably, first transverse locating means spaced apart longitudinally and acting on the axles in order to keep the pressure rollers of the same spinning station aligned longitudinally, and second transverse locating means spaced apart transversely for keeping the two transmission belts of the two adjacent stations, respectively, aligned with engagement surfaces fixed for rotation with the pressure rollers.

2. The locating frame of claim 1, wherein the two pairs of seats are formed in a body made of plastics material.

3. The locating frame of claim 1, wherein the first transverse locating means comprise a pair of opposed and aligned longitudinal arms the ends of which can engage portions of differentiated diameter of the axles.

4. The locating frame of claim 3, wherein the ends of the longitudinal arms are chamfered in directions substantially tangential to the surfaces of the engagement portions of the axles.

5. The locating frame of claim 1, wherein the second transverse locating means comprise a pair of transverse arms having lateral shoulder surfaces for keeping each belt aligned and engaged with the engagement surfaces.

6. The locating frame of claim 5, wherein the transverse arms have end portions of differentiated thickness which define the lateral shoulder surfaces.

7. The locating frame of claim 6, wherein the end portions of the transverse arms have smooth and rounded surfaces for reducing friction against the belts.

8. The locating frame of claim 1, wherein the first and second locating means comprise a pair of transverse arms and a pair of longitudinal arms formed by a substantially cross-shaped element which can be fixed to a lower surface of the body made of plastics material.

9. The locating frame of claim 8, wherein at least one recessed region is formed in the lower surface of said body, for keeping the cross-shaped element oriented in the longitudinal and transverse directions.

10. The locating frame of claim 2, wherein said body has an upper surface arranged for the releasable mounting of a cover of a size such as to cover the region between the two pressure rollers in the two adjacent spinning stations.

11. The locating frame of claim 2, wherein said body has an upper surface arranged for the releasable mounting of a support device for holding a cleaning roller engaged on top of and straddling the two pressure rollers of the same spinning station.

12. The locating frame of claim 2, wherein the upper surface of the plastics body is extended at the front to form an arcuate appendage for protecting the pressure rollers of the compacting units of the two adjacent spinning stations.

13. The locating frame of claim 5, further comprising means for selectively adjusting the height of the transverse arms in order consequently to adjust the degree of tension in the belts.

* * * * *